US005494317A

United States Patent [19]

Johnson

[11] Patent Number: 5,494,317

[45] Date of Patent: Feb. 27, 1996

[54] LOTTERY TICKET

[75] Inventor: James M. Johnson, St. Catharines, Canada

[73] Assignee: 407994 Ontario Limited, St. Catharines, Canada

[21] Appl. No.: 215,460

[22] Filed: Mar. 21, 1994

[51] Int. Cl.[6] ..... B42D 15/00

[52] U.S. Cl. ..... 283/72; 283/100; 283/903

[58] Field of Search ..... 283/100, 105, 283/903, 111, 72

[56] References Cited

U.S. PATENT DOCUMENTS

| | | | |
|---|---|---|---|
| 3,900,219 | 8/1975 | D'Amato et al. | 283/903 X |
| 4,470,016 | 4/1988 | Konecny | 283/903 |
| 5,217,258 | 6/1993 | Sanderson | 283/903 X |
| 5,286,061 | 2/1994 | Behm | 283/903 X |

FOREIGN PATENT DOCUMENTS

| | | | |
|---|---|---|---|
| 2082119 | 4/1981 | United Kingdom | B42D 15/00 |

*Primary Examiner*—Willmon Fridie, Jr.
*Attorney, Agent, or Firm*—Patrick J. Hofbauer

[57] ABSTRACT

A lottery ticket is described having a front sheet which defines a plurality of windows and includes a plurality of bars separating said windows from one another and a plurality of closure panels closing the windows, a rear sheet and an intermediate layer for selectively bonding the front sheet and the rear sheet together. The side of the rear sheet which faces the front sheet bears a plurality of game symbols arranged in sets of symbols, with each set of symbols located within a respective window and including a set of winning symbols located in a winning window. The lottery ticket incorporates a first security indicia which comprises the occurrence in a set of winning symbols of all but one symbol of a uniform size and one symbol of a visibly larger or smaller size. This security indicia may be used alone or in combination with a second security indicia, for example, a printed word indicating that the ticket is a winning ticket.

11 Claims, 3 Drawing Sheets

LOTTERY TICKET

FIELD OF THE INVENTION

This invention relates to the field of lottery tickets and, more particularly relates to a lottery ticket of the "break-open" variety which has a number of windows which can be opened to reveal sets of symbols.

BACKGROUND OF THE INVENTION

It is known in this field of invention to make lottery tickets of the "break-open" variety where a player breaks a seal and pulls back a portion of the ticket to reveal a window in which certain symbols appear. Ordinarily each type of symbol (orange, lemon, cherry etc.) corresponds to a different prize and 15 if three like symbols appear in the window, the player will recognize that the ticket is a winning ticket. Ordinarily, the prizes are fairly small, and tickets are redeemed at the point of purchase, usually a convenience store or charity operator.

One of the key problems of lottery tickets of this type is that an unscrupulous person could create a ticket which appears to be a winning ticket by removing symbols from other non-winning tickets of the same type, and inserting these symbols into one ticket, such that three symbols of a kind appear in one window. Since the are usually redeemed at point of purchase, the cashier who redeems the ticket and awards the appropriate prize would not normally have access to sophisticated means to detect carefully altered tickets. It follows, then, that altered non-winning tickets may be honoured as winning tickets, with a resulting loss of revenue.

In order to prevent this form of cheating, it is known in the prior art to include in the lottery tickets a series of codes by which winning tickets and the correspondence to particular prizes can be determined. These codes tend to be awkward to use, in that reference must be made to an entire series of tickets in order to determine whether a given ticket is truly a winning ticket in that series. Further, by a process of elimination, it can be determined whether remaining tickets in a given series are likely to be winning tickets, simply by reference to the codes of previously redeemed winning tickets of that series. This information could be improperly used to determine whether or not to purchase tickets from a given series.

Accordingly, it is an object of this invention to provide a "break-open" lottery ticket which is not susceptible to tampering, in that no benefit can be gained by tampering since, in order to obtain the symbols necessary to create a winning ticket by tampering, a winning ticket of the same value must be destroyed, and therefore not redeemed.

It is a further object of the present invention to provide a "break-open" lottery ticket in which a novel form of security indicia can be readily noted at a glance by the person validating and honouring the ticket and awarding a prize, with out reference to collateral validity reference sources.

It is a still further object of the present invention to provide a "break-open" lottery ticket in which the ticket security indicia do not provide information which can be used to reduce the odds of locating a winning ticket in a given series of tickets.

SUMMARY OF THE INVENTION

In accordance with the present invention, there is provided a lottery ticket comprising a front sheet, a rear sheet, means bonding said front sheet and said rear sheet together.

A plurality of game symbols are provided on one side of the rear sheet facing the front sheet, which game symbols are arranged in sets of symbols with each set of symbols located within a respective window and a set of winning symbols located in a winning window. A first security indicia comprising the occurrence in the set of winning symbols of all but one symbol of uniform size and one symbol of either visibly larger or smaller size.

In accordance with a further embodiment of the invention, there is additionally provided a second security indicia, positioned in the winning window, which second security indicia comprises a printed word which would indicate to the lottery purchaser and the person honouring the ticket, that the ticket is a winning ticket. For example, the word "winner" may be used.

Other advantages, features and characteristics of the present invention, as well as methods of use and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

Like reference numerals are used in the various Figures to identify analogous structures in the several embodiments illustrated.

DETAILED DESCRIPTION OF A PREFERRED EMBODIMENT

Figure 1:
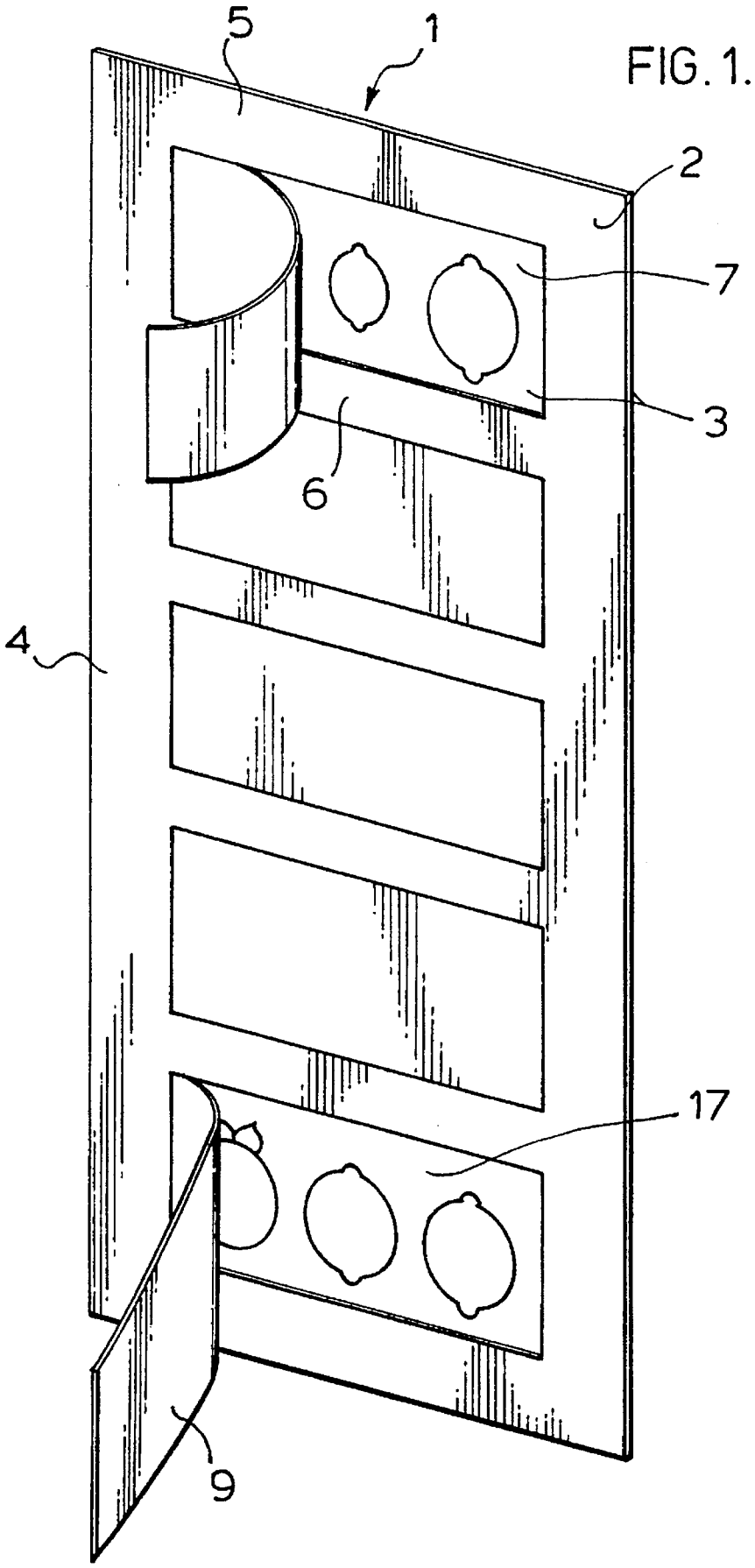
FIG. 1 of the drawings appended hereto is a perspective view of a preferred embodiment of a lottery ticket according to the present invention.

Reference will now be made to FIG. 1, which shows a preferred embodiment of lottery ticket, according to the invention, generally denoted by reference numeral 1. The lottery ticket 1 comprises a front sheet 2 and a rear sheet 3. The front sheet 2 has two vertical side strips 4 and top and bottom strips which define the periphery of the front sheet 2, each of the strips 4 and 5 being of generally uniform width. Four bars 6 extend between vertical strips 4, to define a series of five generally similar windows 7. The rear sheet 3 is printed on one side, being its front side 17, with game symbols 8 arranged into five sets of three symbols each, aligned so that one set of symbols is positioned within a respective window 7.

Closure panels 9 are integrally formed as a part of the front sheet 2. Each closure panel 9 is die cut from the front sheet to form, simultaneously, a closure panel 9 and a respective window 7. The panel 9 is separated by perforations along three sides from the surrounding parts of the front sheet 2. The left hand side of each panel 9 is continuous with one side strip 4, so as to be capable of being folded back as shown in FIG. 1. In the preferred embodiment shown, the front sheet, except for the panels 9, is glued to the rear sheet by patterned gluing, with the sets of symbols aligned, as aforesaid, behind their respective windows 7.

Different game symbols can be used, although it is common to use pictures of fruit and rectangles bearing the word "bar", in order to imitate the symbols which traditionally appear on slot machines. A variety of combinations are pre-determined as winning combinations, usually sets of three identical symbols and each winning combination corresponds to a pre-determined prize. It will be appreciated that, while this description relates to sets of three symbols, a different number of symbols could be used, in each set.

Figure 2:
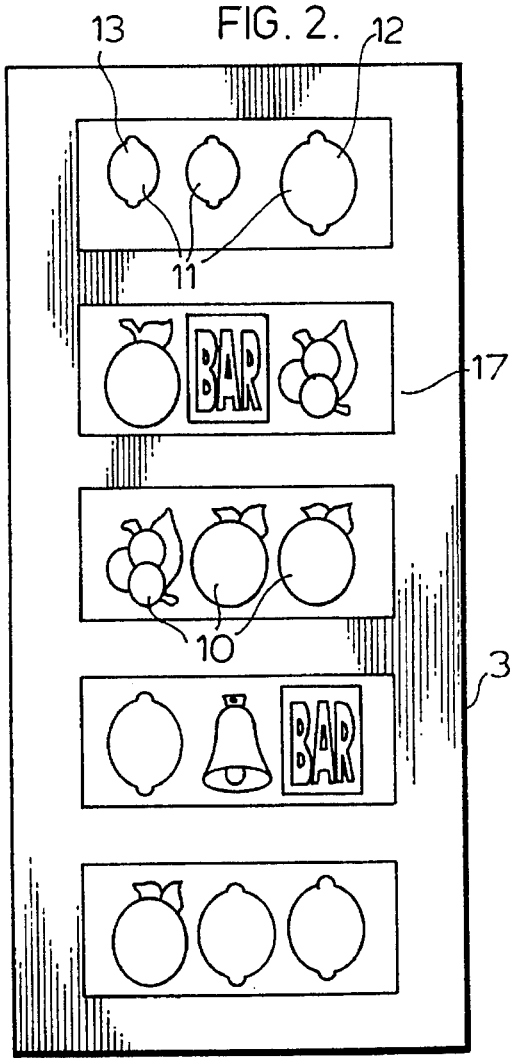
FIG. 2 of the drawings is a frontal view of the rear sheet of the lottery ticket, of FIG. 1.

FIG. 2 depicts the rear sheet of the winning ticket of FIG. 1. Various possible combinations of symbols appear in each set of symbols on the front side 17 of the rear sheet 3. Non-winning sets 10 are identifiable in that the game symbols depicted therein are not three of a kind. In contrast, winning sets 11 of symbols comprise three like game symbols. In accordance with the preferred embodiment of the present invention, the security indicia of the winning set 10 has one game symbol 12 that is visibly larger than the two game symbols of uniform size 13. Thus, in order to alter a losing ticket to successfully imitate a winning ticket, a true winning ticket must be destroyed in order to obtain a recognizably larger symbol 12 necessary in order to create a winning combination 11. As all true winning tickets would be returned to the seller upon redemption, there would be no advantage to ticket purchasers if such alteration was to occur.

Figure 3:
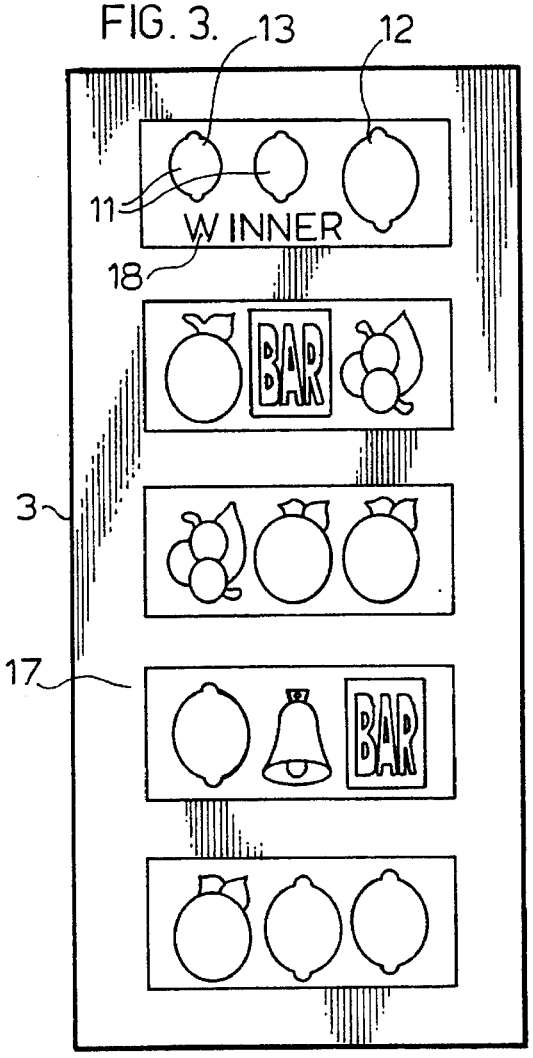
FIG. 3 of the drawings is a frontal view of the rear sheet of an alternate second embodiment of lottery ticket according to the present invention.

FIG. 3 depicts the rear sheet of a winning lottery ticket according to an alternate second embodiment of the present invention. As in FIG. 2, various possible combinations of symbols appear in each set of symbols on the front side 17 of the rear sheet 3. Non-winning sets 10 of symbols are identifiable in that the game symbols depicted therein are not three of a kind. Winning sets 11 of symbols appear, sized as in FIG. 2. A second security indicia 18 additionally appears on the front side 17 of rear sheet 3. In this embodiment the second security indicia 18 is the printed word "winner". The second security indicia 18 must appear together with the set of winning symbols 11 in order to be a winning ticket in accordance with this embodiment of the present invention. In order to alter a losing ticket to successfully imitate a winning ticket, a true winning ticket must be destroyed in order to obtain the printed material which comprises the second security indicia 18 and the recognizably larger symbol 12 necessary in order to create a winning set of symbols 11.

Figure 4:
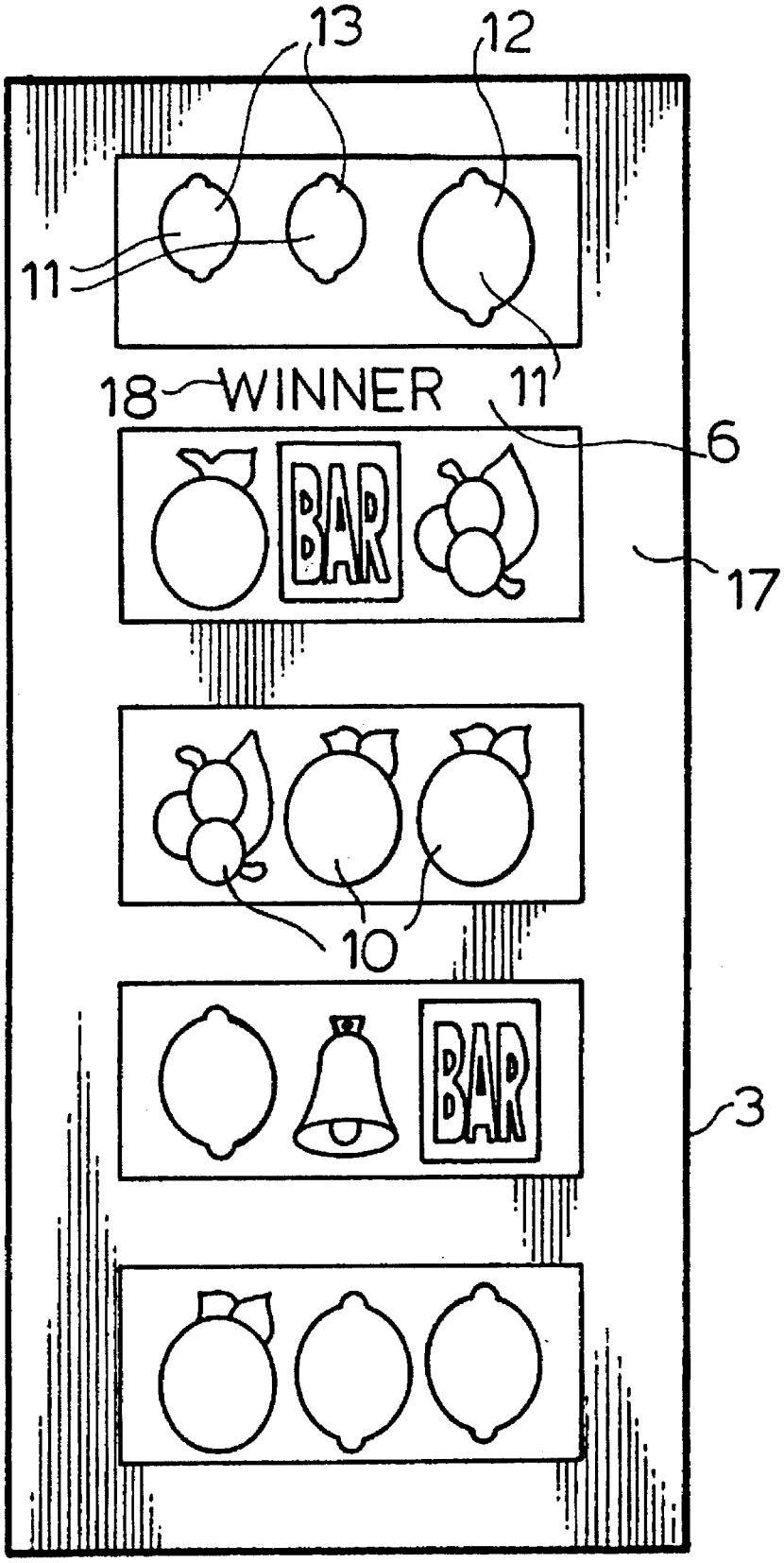
FIG. 4 of the drawings is a frontal view of the rear sheet of an alternate third embodiment of lottery ticket according to the present invention.

FIG. 4 depicts the rear sheet of a winning lottery ticket in accordance with an alternate third embodiment of the present invention. As in FIG. 3, various possible combinations of symbols appear in each set of symbols on the front side 17 of the rear sheet 3. Non-winning sets 10 of symbols are identifiable in that the game symbols depicted therein are not three of a kind. Winning sets 11 of symbols appear, sized as in FIG. 2. A second security indicia 18 additionally appears on the front side 17 of rear sheet 3. In this embodiment the second security indicia 18 is the printed word "winner". The second security indicia 18 must appear below the winning set 11 of symbols in bar 6, such that it would not appear to the purchaser who opened the winning ticket, but could be revealed by the person who validates and honours the winning ticket as by separating the front sheet 2 from the rear sheet 3, thereby destroying the integrity of the ticket. It is understood, that a ticket already destroyed in the manner indicated, at the time of redemption by the purchaser, would not be honoured as a winning ticket.

It will be appreciated that the above description addresses but three possible embodiments of the invention, and that many non-inventive, routine modifications are possible. For example, a winning symbol 11 composed of two large and one visibly smaller like game symbols may be substituted for the two small and one visibly larger winning symbol set shown in the Figures. Moreover, there could be added to the invention a further security indicia, for example, the occurrence in a winning window of a graphic design such as a representation of a circle, square, triangle or other geometric shape. Further, the invention may be practised to generate a lottery ticket having only one break open window. Thus, the invention is limited only by the scope of the appended claims.

I claim:

1. A lottery ticket comprising:

a front sheet which defines a plurality of windows and includes a plurality of bars separating said windows from one another and a plurality of closure panels closing said windows;

a rear sheet;

a means selectively bonding said front and rear sheets together;

a plurality of game symbols on the side of the rear sheet facing the front sheet, which game symbols are arranged in at least two sets of symbols with each of said sets of symbols being located within a respective window;

a set of winning symbols, being a sub-set of said at least two sets of symbols, with all symbols of said sub-set being like game symbols; and, a first security indicia comprising the occurrence in the set of winning symbols of one of said winning symbols being of either visibly larger or smaller size than the remainder of said winning symbols.

2. A lottery ticket according to claim 1 wherein a second security indicia appears in said winning window.

3. A lottery ticket as claimed in claim 2 wherein said second security indicia is one or more printed words.

4. A lottery ticket as claimed in claim 2, wherein said second security indicia is located under a selected one of said bars separating said windows.

5. A lottery ticket as claimed in claim 4, wherein said second security indicia is a printed word.

6. A lottery ticket as claimed in claim 5, wherein said one or more printed words is selected from the group comprising: "winner", and "you have won".

7. A lottery ticket according to claim 1, wherein said first security indicia comprises the occurrence in the set of winning symbols of two small symbols and one visibly larger symbol.

8. A lottery ticket according to claim 1, wherein said first security indicia comprises the occurrence in the set of winning symbols of two large symbols and one visibly smaller symbol.

9. A lottery ticket as claimed in claim 1, wherein a third security indicia appears in said winning window.

10. A lottery ticket according to claim 9, wherein said third security indicia is a graphic design.

11. A lottery ticket according to claim 10, wherein said graphic design consists of a representation of a geometric shape selected from the group comprising: circle, square, triangle.

* * * * *